United States Patent [19]

Bury

[11] 3,982,490

[45] Sept. 28, 1976

[54] YARN JERKER SYSTEM FOR TUFTING MACHINES

[75] Inventor: Fred Bury, Blackburn, England

[73] Assignee: The Singer Company, New York, N.Y.

[22] Filed: Sept. 17, 1975

[21] Appl. No.: 614,031

[52] U.S. Cl. ..... 112/79 R
[51] Int. Cl.[2] ..... D05C 15/18
[58] Field of Search ..... 112/79 R, 79 A, 79 FF, 112/78

[56] References Cited

UNITED STATES PATENTS 3,738,293 6/1973 Parsons ..... 112/79 R

FOREIGN PATENTS OR APPLICATIONS 1,178,589 1/1970 United Kingdom ..... 112/79 A

*Primary Examiner*—H. Hampton Hunter
*Attorney, Agent, or Firm*—Edward L. Bell; Robert E. Smith; Alan Ruderman

[57] ABSTRACT

An adjustable yarn jerker system for a tufting machine including a movable jerker member secured to the needle bar and a split adjustable stationary jerker secured to the machine frame. The split adjustable jerker comprises a bar adjustably moveable relative to the machine frame carrying a first jerker member and a slide member adjustable relative to the bar and carrying a second jerker member. The first and second jerker members being independently adjustable the pull back on the respective yarns are selectively controlled.

5 Claims, 2 Drawing Figures

YARN JERKER SYSTEM FOR TUFTING MACHINES

BACKGROUND OF THE INVENTION

This invention relates to tufting machines and more particularly to a yarn jerker system therefore for controllably applying different degrees of pull-back on the yarns of selective needles.

It is known to provide a yarn jerker system in tufting machines comprising a jerker member moveable in sychronism with the needle bar and cooperating with a fixed jerker member to tension the yarn and set the stitch in the backing when the needles are at the top of their stroke. The fixed yarn jerker member may be adjustable to vary the yarn path length between the yarn feed assembly and the needles to thereby vary the pull-back in accordance with tufting conditions and the yarn in use. For example, the greater the elasticity of the yarn, the greater the pull required for the same effect. One such adjustable system is illustrated in Parsons, U.S. Pat. No. 3,738,293.

It is sometimes desirable to thread the machine so as to tuft simultaneously with more than one type of yarn, i.e., yarns of different elasticity. For example, carpeting comprising a bulk continuous filament nylon and an acrylic or any spun yarn has aesthetic properties which may be desirable. However, since the tensioning and feeding of yarns of different elasticity are dissimilar, undesirable variations in loop levels have been produced in the product. The known yarn jerker systems have not been successful in compensating for these differences in the yarns. Moreover, the known yarn jerker systems are not by themselves capable of producing textured effects on tufting while the machine is threaded with the same yarn.

SUMMARY OF THE INVENTION

Accordingly, it is the primary object of the present invention to provide a yarn jerker system for enabling a tufting machine to produce level effects when tufting simultaneously with yarns of different elasticity.

This objective is accomplished by splitting one of the fixed or moveable jerker members so as to provide more than one such jerker member with each said member independently adjustable relative to the tufting machine frame. In the preferred form of the invention the fixed jerker is split and comprises a jerker bar adjustably positionable relative to the tufting machine frame carrying a first jerker member, and a slide member carrying a second jerker member adjustably mounted on the bar. This effects a leveling condition of the loops in the backing by compensating for the greater elasticity of one yarn relative to the other. The yarn with the greater elasticity may be given a greater pull so as to give it the same tuft height. The construction is such that patterning or texturing effects can also be obtained when tufting with a single type of yarn by back-pulling the yarn from selective needles more than from other needles by threading the selected yarns through the jerker member giving the longer yarn path length. By properly choosing the threading sequence through alternate jerkers interesting texturing effects such as stripes, corduroys and checkerboards may be possible.

It is therefore another object of the present invention to provide a yarn jerker system for a tufting machine whereby differing amounts of jerk or pull-back can be applied to the yarns selectively.

A further object of this invention is to provide a yarn jerker system for a tufting machine that can effect selective texturing by control of the pull applied to the yarn threaded through different needles.

BRIEF DESCRIPTION OF THE DRAWINGS

Other objects and advantages of this invention will best be understood upon reading the following detailed description of the invention with the accompanying drawings, in which.

DESCRIPTION OF THE PREFERRED EMBODIMENT

Figure 1:
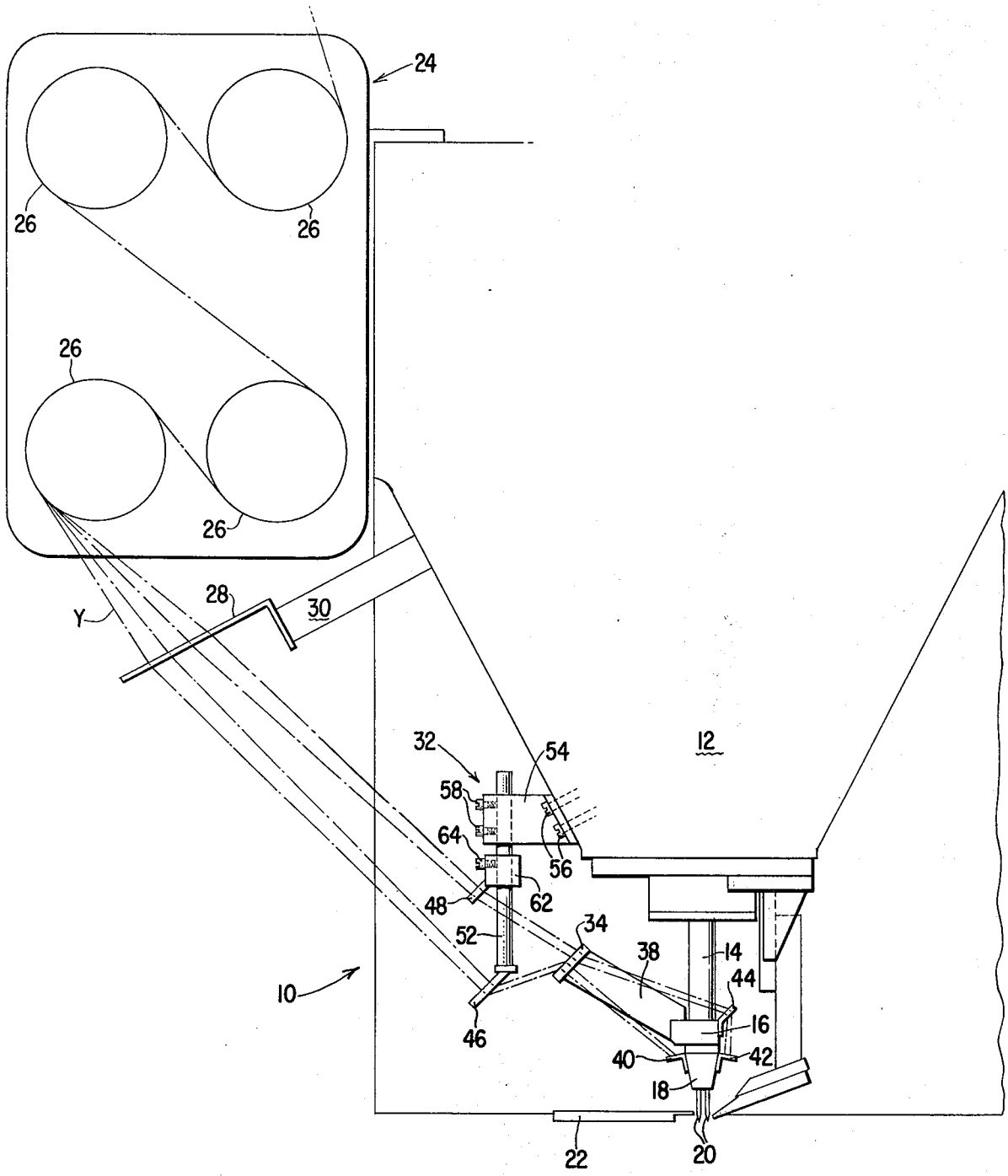
FIG. 1 is an end elevational view of a portion of a tufting machine having a yarn jerker system constructed in accordance with the present invention.
Figure 2:
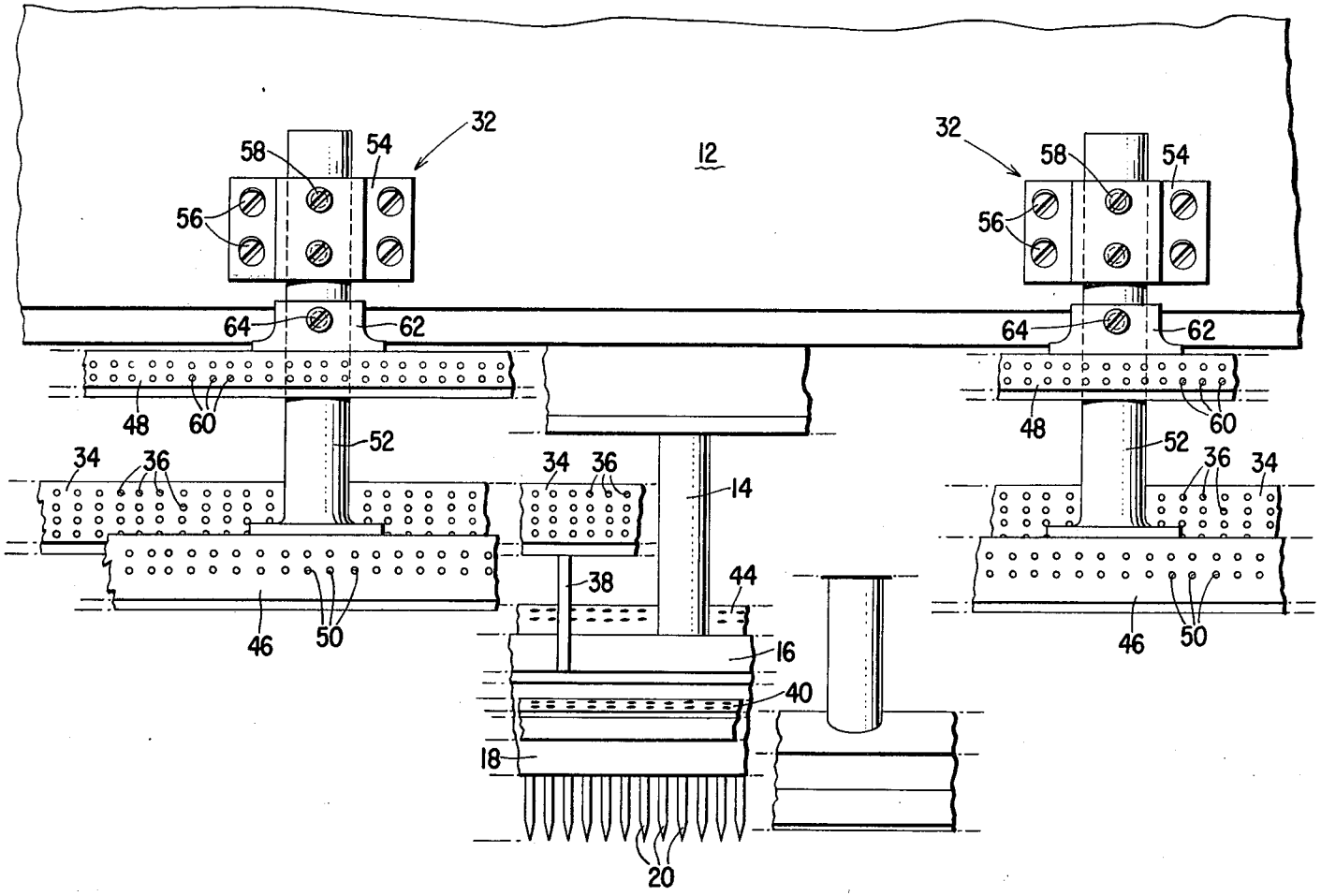
FIG. 2 is a fragmentary front elevational view of the mechanism illustrated in FIG. 1 as viewed from the left side therein.

Referring now to the drawings, in which like reference numerals are used for corresponding parts in the two views, there is disclosed a yarn jerker system for a tufting machine generally designated at 10 including a head 12. Mounted conventionally in the head for vertical reciprocation is a push rod 14 to the lower end of which is secured a foot 16 supporting a needle bar 18. Secured in the needle bar is a multiplicity of needles 20 longitudinally disposed across the width of the machine in a single row or in multiple rows as illustrated. The choice of the specific needle arrangement is not part of the present invention although the needle array determines the path of the yarns. In the usual manner the needles cooperate with loopers (not shown) mounted below a bed plate 22 in a bed (also not shown) to form loops in a backing fabric passing over the plate 22. For simplicity of illustration only the upper portion of the tufting machine is shown to illustrate the invention. It is to be understood that the lower portion is conventional and well-known.

Yarn Y is fed to the needles 20 by a yarn feed assembly 24 comprising a plurality of feed rollers 26 about which the yarn is wound. The yarn is positively fed to the needles with the amount each needle cycle being determined by the rotational speed of the rollers on which the yarn strands are wound. The yarn feed assembly may of course include a pattern attachment whereby the amount of yarn fed to the individual needles may be varied by driving the feed rollers selectively at different speeds determined by a pattern control.

The yarn which is positively fed from the feed roller assembly to the needles, passes through a yarn spreader guide 28 comprising a perforated plate secured to the head 12 of the tufting machine by means of a bracket 30. The spreader guide spreads or separates the individual yarns from adjacent yarns fed from the rollers 26 and guides them to the fixed yarn jerker designated generally as 32 which will be hereinafter described in detail. From the fixed jerker 32 the yarn is threaded through a moveable jerker member 34 which comprises a plate having a multiplicity of apertures 36 for receiving the individual yarn ends. The moveable jerker may be mounted on the push rod foot 16 by means of bracket 38 so as to reciprocate with the push rods and needle bar. The yarn from the moveable jerker 34 is thereafter threaded through an apertured yarn guide 40 secured to the front of the needle bar for guiding the yarn to the front row of needles. If a second row of needles is provided as illustrated, yarn ends from the guide 34 are also fed to the needles through the guide 42 mounted on the rear of the needle bar 18. A further yarn guide 44 mounted on the push rod foot 16 may be provided to guide the yarn from the moveable jerker 34 to the guide 42.

In accordance with the present invention the fixed jerker 32 is split to comprise a first jerker member 46 and a second jerker member 48. The first jerker member 46 comprises a plate having a plurality of apertures 50 supported on the lower end of a jerker support bar 52. The bar 52 is slidably received within a bracket 54 secured in conventional manner such as screws 56 to the head 12 of the tufting machine. The bar may be adjustably positioned within the bracket by conventional means, for example set screws 58 acting on a flat on the bar. The second jerker member 48 comprises a plate having apertures 60 secured to a slidable carriage 62 positioned on the bar 52 and adjustable relative thereto. Conventional means such as set screws 64 may secure the carriage 62 to the bar 52 at selected positions.

It should be understood that the first jerker member 46 is adjustable relative to the tufting machine frame and the second jerker member 48 is adjustable relative to the first jerker member and the tufting machine frame. Thus, the path length of the yarn through the second jerker member from the feed rollers to the needle can be varied independently of the path length of the yarn through the first jerker member from the feed rollers to the needle. The tension on each strand of yarn passing through the second jerker member can therefore be set as desired for that yarn independently of the tension on the yarn passing through the first jerker member. Moreover, the path length of the yarn through both jerker members can simultaneously be adjusted relative to the tufting machine frame. Since the yarn feed assembly positively feeds a fixed amount of yarn to the needles, and the moveable jerker 34 pulls yarn when the needles are at the top of the stroke to set the loop in the backing fabric, the loops formed by the yarn passing through the first jerker member can be pulled more than the loops formed by the yarn passing through the second jerker member. Hence, leveling conditions can be obtained in the loops when yarn of different elasticity are threaded through the jerker members, the yarn of greater elasticity being threaded through the first jerker member and the other yarn through the second jerker member. The relative positions of the first and second jerker members are of course adjusted in accordance with the specific yarn being used. Moreover, when the same types of yarn are threaded through the two jerker members one yarn is pulled back more than the others so that loops of different heights can be formed to create patterning effects.

Numerous alterations of the structure herein disclosed will suggest themselves to those skilled in the art. For example, the adjustable members may be on the moveable jerker rather than the fixed jerker. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what we claim herein is:

1. A yarn jerker system for a tufting machine having a frame supporting a reciprocating needle bar carrying a plurality of needles, said jerker system comprising a fixed jerker carried on the frame, and a reciprocating jerker carried by said needle bar for pulling yarn from the fixed jerker, at least one of said jerkers comprising first and second jerker members, means for adjustably mounting said first jerker member relative to said second jerker member and for adjustably mounting both said first and second jerker members relative to said tufting machine frame, whereby yarn threaded through said first jerker may be selectively controlled independently of yarn threaded through said second jerker.

2. A yarn jerker system for a tufting machine as recited in claim 1 wherein said means comprises a support member adjustably mounted relative to the frame and a carriage adjustably positioned on said support member, means for securing said first jerker member to said carriage, and means for securing said second jerker to said support member.

3. A yarn jerker system for a tufting machine as recited in claim 2 wherein said support member comprises a longitudinally shiftable elongate member, and said carriage is longitudinally slidable on the support member.

4. A yarn jerker system for a tufting machine as recited in claim 3 wherein said first and second jerker members comprise said fixed jerker, bracket means on said tufting machine frame for slidably receiving said elongate member, and means for selectively securing said elongate member in the bracket.

5. A yarn jerker system for a tufting machine as recited in claim 3 wherein said support member is longitudinally shiftable in a direction substantially parallel to the direction of reciprocation of the needle bar.

* * * * *